US006217152B1

(12) United States Patent
Chiba et al.

(10) Patent No.: US 6,217,152 B1
(45) Date of Patent: Apr. 17, 2001

(54) FILM MEMBER FOR USE IN INK-TRANSFER-TYPE PRINTER

(75) Inventors: Toru Chiba, Tokyo; Minoru Suzuki, Tochigi-ken, both of (JP)

(73) Assignee: Asahi Kogaku Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/537,177

(22) Filed: Mar. 29, 2000

(30) Foreign Application Priority Data

Mar. 30, 1999 (JP) ..... 11-89449

(51) Int. Cl.[7] ..... B41J 27/20; B41J 2/325
(52) U.S. Cl. ..... 347/47
(58) Field of Search ..... 347/44, 47

(56) References Cited

FOREIGN PATENT DOCUMENTS 10-799 * 1/1998 (JP) .
10-147031 * 6/1998 (JP) .
10-147032 * 6/1998 (JP) .
10-193654 * 7/1998 (JP) .
10-329345 * 12/1998 (JP) .

* cited by examiner

*Primary Examiner*—Huan Tran
(74) *Attorney, Agent, or Firm*—Greenblum & Bernstein, P.L.C.

(57) ABSTRACT

A film member adapted to be employed in an ink-transfer-type printer in which a film member having a plurality of pores is disposed between a recording sheet and ink is disclosed. The ink and film member are heated by a heating means so that the pores are selectively expanded to allow the ink to permeate the expanded pores to be transferred onto a recording sheet. The film member comprises at least an integrated pair of layers, the uppermost layer of which is made of a low-friction material, while the lowermost layer is made of an elastomer. The plurality of pores are formed to extend through the integrated layers.

8 Claims, 5 Drawing Sheets

FILM MEMBER FOR USE IN INK-TRANSFER-TYPE PRINTER

BACKGROUND OF THE INVENTION

The present invention relates to an ink-transfer-type printer which transfers ink to a recording sheet (such as a plain paper) to form an image thereon, and more particularly to a film member to be employed in the ink-transfer-type printer.

One of the present inventors has proposed an ink-transfer-type printer as disclosed in Japanese laid-open patent publication No. Hei 10-329345 published on Dec. 15, 1998, which employs a film member having a plurality of pores extending in a direction of the thickness of the film member. One surface of the film member is arranged to contact a recording sheet while the other surface to face a thermal line head with holding ink therebetween.

The pores of the film member are designed to normally prevent the permeation of ink. However, in case the thermal line head generates heat based on print information, the heated portions of the film member become easy to be elastically deformed so that the pores in the heated portions become easy to be widened. Then, the pores allow the penetration of ink therethrough to be transferred onto a recording sheet contacted to the opposite side of the film member.

Thus, by moving a recording sheet, with keeping the contact with the film member surface, in the direction perpendicular to the thermal line head while the heat control of the thermal line head is being continuously performed based on print information, a two-dimensional ink image can be formed on a recording sheet.

In the above ink-transfer-type printer, in order to allow a recording sheet to slide on a film member, the friction coefficient of the film member surface to which a recording sheet contacts must be small. Further, a film member must have such a characteristic as that pores formed in the film member must become easy to be widened when heated. For satisfying the above requirements, a film member made of polytetrafluoroethylene (for instance, "Nifutoron" produced by Nitto Denko K.K.) has been employed.

With the above film member, however, sometimes trailings of ink on a recording sheet have occurred during printing operation. The reason why this occurs seems because polytetrafluoroethylene needs relatively large amount of heat to change the elasticity thereof, so that it takes time to close the pores of the film member after heat generation at the thermal line head is ceased, than allowed for performing clear printing.

SUMMARY OF THE INVENTION

It is therefore an object of the present invention to provide an improved film member, the pores of which can be timely closed to prevent trailings of ink during printing operation, while having a small friction coefficient at the surface thereof.

For the above purpose, in accordance with the present invention, there is provided a film member adapted to be employed in an ink-transfer-type printer in which a film member having a plurality of pores is disposed between a recording sheet and ink, the ink and the film member being heated by a heating means so that the pores are selectively expanded to allow the ink to permeate the expanded pores to be transferred onto a recording sheet, the film member comprises: at least an integrated pair of layers, the uppermost layer of which is made of a low-friction material whose elasticity is changed when heated while the lowermost layer is made of an elastomer, the plurality of pores being formed to extend through the integrated layers.

The uppermost layer of the film member faces a recording sheet to contact therewith when employed in the ink-transfer-type printer, and it is preferable that the low-friction material is one of or the mixture of more than one of polytetrafluoroethylene, polydifluoroethylene, polyurethane and polyethylene.

The lowermost layer of the film member faces a thermal line head through ink, and it is preferable that the elastomer is one of or the mixture of more than one of silicon rubber, polyethylene, polypropylene, polyvinyl acetate, chloroprene, isoprene, polyurethane and polyamide.

With the above constituted film member, when it is employed in a ink-transfer-type printer, the elasticity of the uppermost layer is changed to allow the pores to be widened at the portions selectively heated, and the corresponding pores of the lowermost layer are widened by the expanding pressure of ink at the portions selectively heated, thereby allowing ink to permeate through the selected pores of the uppermost and lowermost layers. On the other hand, when selective heating is ceased, the elasticity of the uppermost layer returns to its normal state to prevent permeation of ink through the pores thereof, and the pores of the lowermost layer are closed as the expanding pressure of ink dismisses. Here, even if it is delayed for the pores of the uppermost layer to be closed, the permeation of ink can be timely prevented as the corresponding pores of the lowermost layers are closed immediately when the expanding pressure of ink dismissed.

Optionally, a plurality of fillers may be dispersed in the lowermost layer. That is, as the lowermost layer is made of an elastomer, some cracks may appear around the inner circumferential surfaces of the pores thereof after repeated usage thereof. If the cracks are progressed and extended in the lowermost layer, the durability of the lowermost layer will decrease and it becomes difficult to function as designed. In order to prevent it, a plurality of fillers are to be dispersed in the lowermost layer.

Preferably, each of the fillers is of a substantially cylindrical shape made of glass, and the amount of the fillers to be dispersed is in the range of 0.1 wt % to 20 wt % of the lowermost layer. More preferably, the amount of the fillers is to be in the range of 1 wt % to 5 wt %.

In the preferred embodiment, the lowermost layer of the film member is directly integrated with the uppermost layer.

DESCRIPTION OF THE PREFERRED EMBODIMENTS

An ink-transfer-type printer embodying the invention will be described hereafter by referring to the accompanying drawings.

Figure 1:
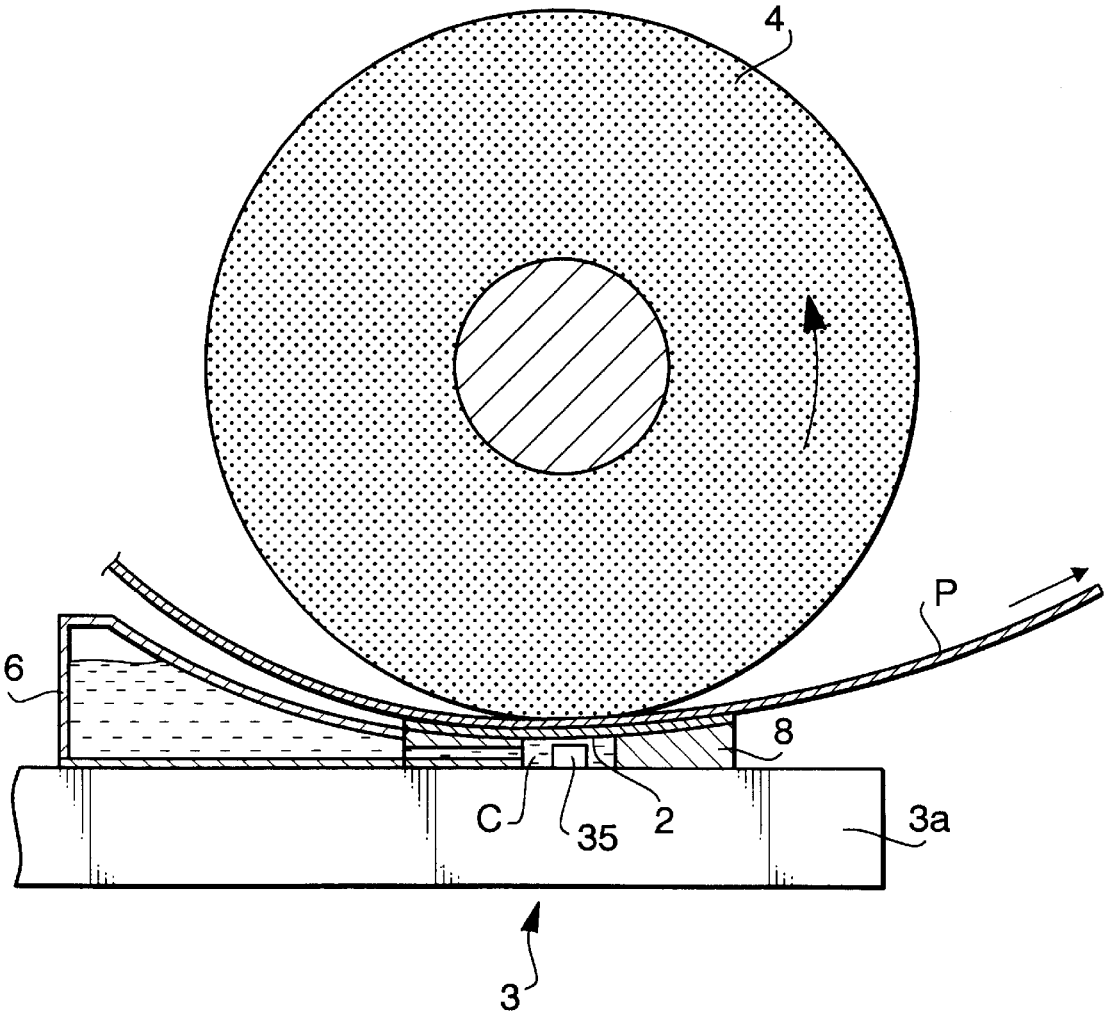
FIG. 1 is a sectional view showing a principal constitution of an ink-transfer-type printer embodying the invention.

FIG. 1 is a side sectional view showing a principal constitution of the ink-transfer-type printer 1 embodying the invention. The printer comprises a thermal line head 3 having a plurality of heating elements 35 arranged in the direction perpendicular to the drawing direction of a print sheet, and a film member 2 secured to the thermal line head 3 via a spacer 8 to leave the clearance of 0.1 mm therebetween.

The spacer 8 and a casing 3*a* of the thermal line head 3 are made of materials which does not allow ink to pass therethrough. The area surrounded by the film member 2, the spacer 8 and the casing 3*a* of the thermal line head 3 constitutes an ink-space C for holding ink therein. The film member 2 is arranged to be slightly away from or contact the heating elements 35 of the thermal line head 3.

Above the film member 2, a platen roller 4 is disposed to press a recording sheet P against the upper surface of the film member 2. The platen roller 4 is a so-called rubber roller, and is disposed such that the axis of the roller 4 is coincident with the direction of arrangement of the heating elements 35 of the thermal line head 3. When the platen roller 4 is rotated, traction force is applied to the recording sheet P, which is fed in the direction of the arrow in FIG. 1.

Figure 2:
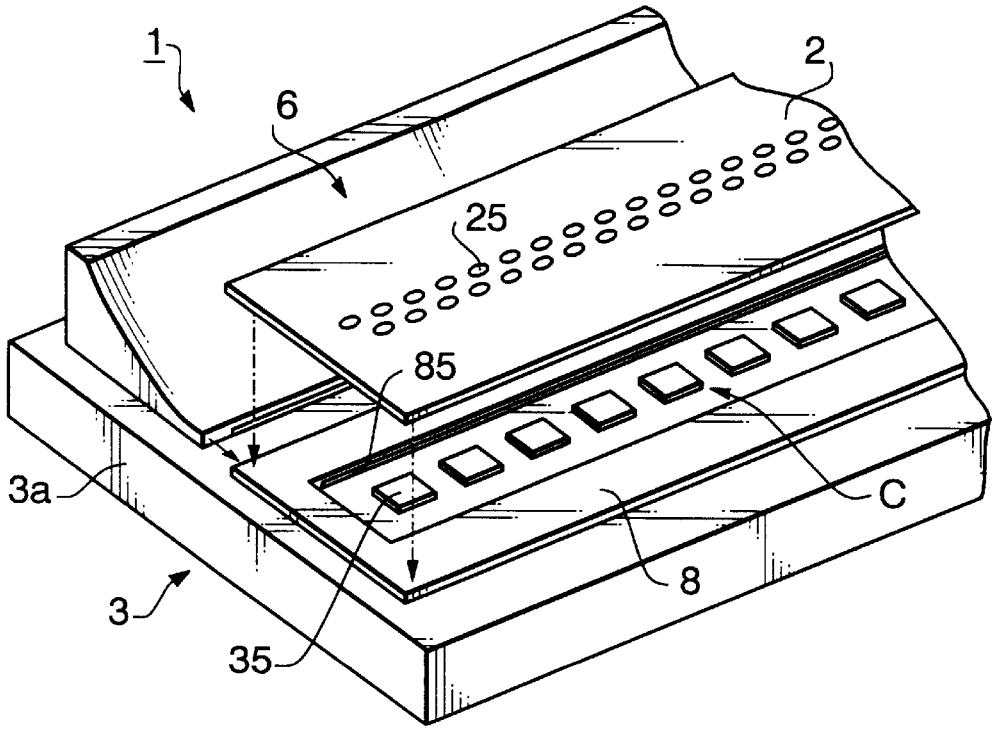
FIG. 2 is a perspective view showing essential parts of the printer of FIG. 1.

FIG. 2 is an exploded perspective view of the printer 1 excluding the platen roller 4. The spacer 8 comprises a thin frame plate having a square opening for receiving a plurality of heating elements 35 which are arranged to form a line. All the heating elements 35 are accommodated in the ink-space C. Beside the ink-space C, an ink reservoir 6 is provided and ink in the ink reservoir 6 is led into the ink-space C through a connecting slit 85 formed in the spacer 8 due to capillarity.

Figure 3:
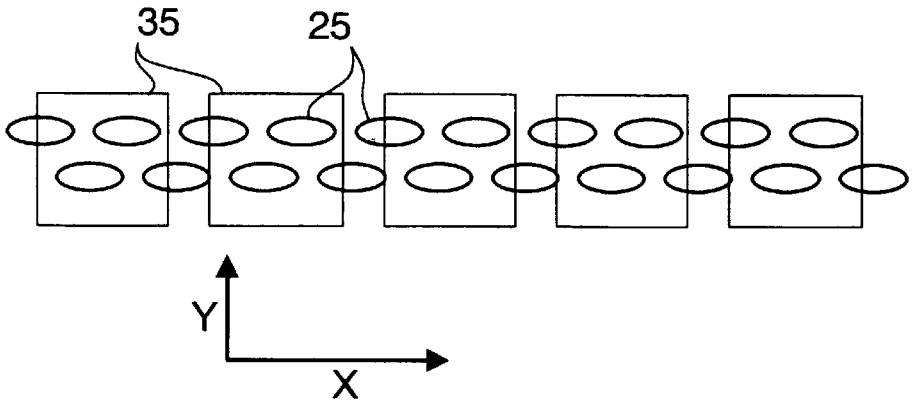
FIG. 3 shows the heating elements in a thermal line head and the pores in a film member.

The film member 2 is provided with a plurality of pores 25 which are placed above the heating elements 35 when the film member 2 is adhered onto the spacer 8. At the room temperature and the normal pressure, the size of each pore is such that the pore does not allow the penetration of ink (liquid) and solvent vapor thereof. FIG. 3 shows the locational relationship between the pores 25 and the heating elements 35. In the direction in which the heating elements 35 are disposed (i.e., a main scanning direction: direction X), a plurality of pores 25 correspond to a single heating element 35. In addition, the pores 25 are staggered in the direction perpendicular to the above direction (i.e., a sub-scanning direction: direction Y).

Figure 4A:
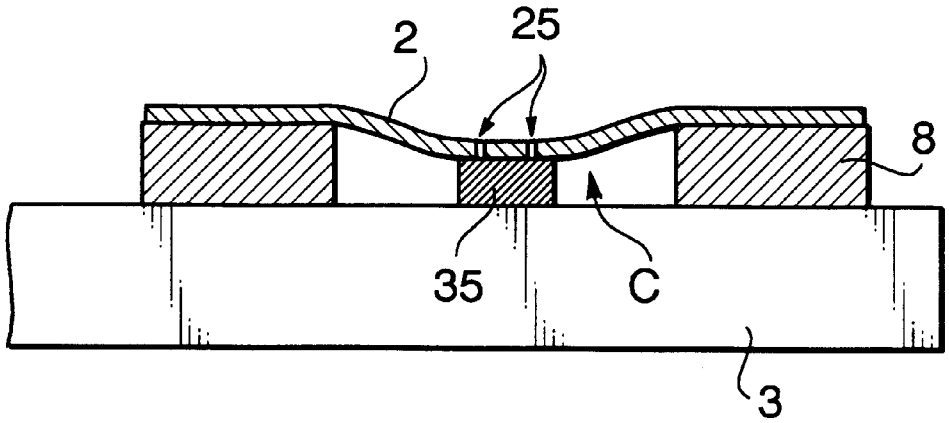
FIG. 4A and 4B are sectional views for explaining principles of image formation with the ink-transfer-type printer of FIG. 1.
Figure 4B:
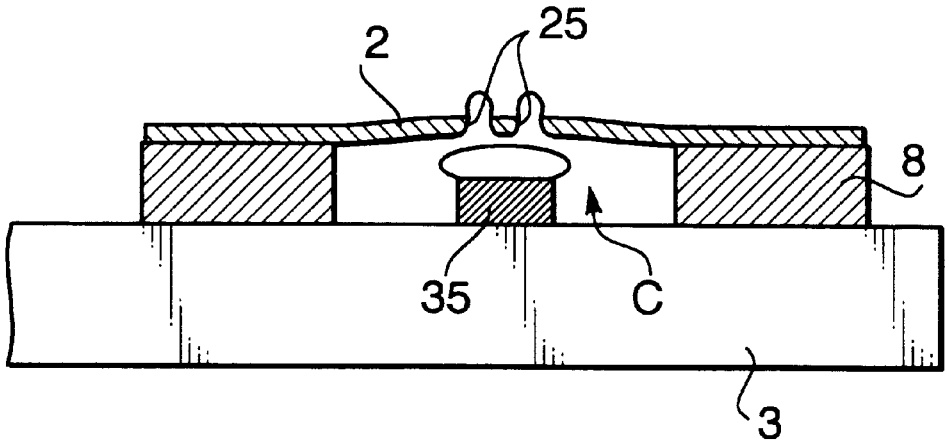

FIGS. 4A and 4B are schematic views for explaining the principles to form an image by the ink-transfer-type printer embodying the invention. In these figures, the ink reservoir 6 and the platen roller 4 are omitted.

In FIG. 4A, when the heating elements 35 generate heat, the ink around the heating elements 35 as well as the portions of the film member 2 near the heating elements 35 are heated. As illustrated in FIG. 4B, the ink heated by the heating elements 35 is evaporated and/or expanded to increase the pressure locally, and the heated portions of the film member 2 become easy to be deformed as the elastic modules decreases.

Thus, the ink is pressed against the pores 25 of the film member 2 due to the above pressure increase, and the pores 25 are deformed to increase the opening sizes to allow the ink to pass therethrough. Thereby, the ink is transferred onto the recording sheet P (see FIG. 1) which is contacted to the other side of the film member 2.

Thereafter, upon cease of heat generation by the selected heating elements 35, the heated ink and the heated portions of the film member 2 are cooled down by the surrounding ink, and the opening sizes of the deformed pores 25 are restored to the normal ones, i.e., the sizes which do not allow the ink to pass therethrough.

Then, by controlling the heat generation with the heating elements 35 of the thermal line head 3 in accordance with the printing data while transferring the recording sheet P by rotating the platen roller 4, the two-dimensional ink image is formed on the recording sheet P.

In the meantime, by combining more than one of the above described printers, a color printer unit can be constituted as explained in Japanese laid-open patent publication No. Hei 10-329345, the entire disclosures of which are incorporated in this specification as a reference.

Next, the structure of the film member 2 will be described in detail.

Figure 5:
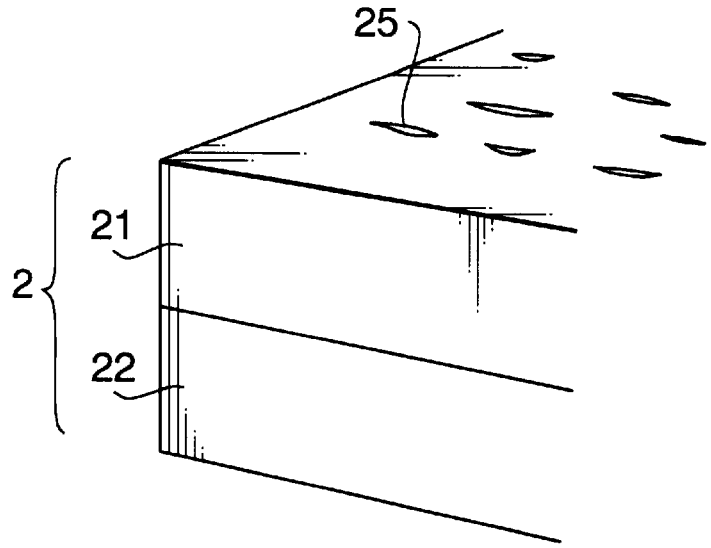
FIG. 5 shows the structure of a film member embodying the invention.

As shown in FIG. 5, the film member 2 has a double-layered structure consisting of a first layer 21 and a second layer 22. The first layer 21 is made of a low-friction material, the elasticity of which is changed when heated, while the second layer 22 is made of an elastomer. The pores 25 are formed by making a plurality of slits extending through the integrated first and second layers 21 and 22 by means of an edged tool or the like. These pores 25 are however represented as ellipses in FIGS. 2 and 3 for explanatory purpose.

As the low-friction material for the first layer 21, one or the mixture of more than one of polytetrafluoroethylene, polydifluoroethylene, polyurethane and polyethylene is to be selected. As the elastomer for the second layer 22, one or the mixture of more than one of silicon rubber, polyethylene, polypropylene, polyvinyl acetate, chloroprene, isoprene, polyurethane and polyamide is to be selected.

As the first layer 21 which is to contact a recording sheet is made of a low-frictional material, a sliding movement of a recording sheet with respect to the film member 2 becomes smooth and the wear-out of the surface of the film member 2 is decreased. Further, as the low-friction materials listed above are of water repellency, the ink which reached the film surface (which is hydrophilic) through the broadened pores 25 is surely transferred onto a recording sheet P and does not remain on the film surface.

Further, since the elastomers listed above are of heat resistance, they are suitable as the materials for the second layer 22 which directly receives heat from the thermal-line head 3.

FIGS. 7A through 7D illustrate one example way to fabricate the above-described film member 2 of integrated double-layers.

Figure 7A:
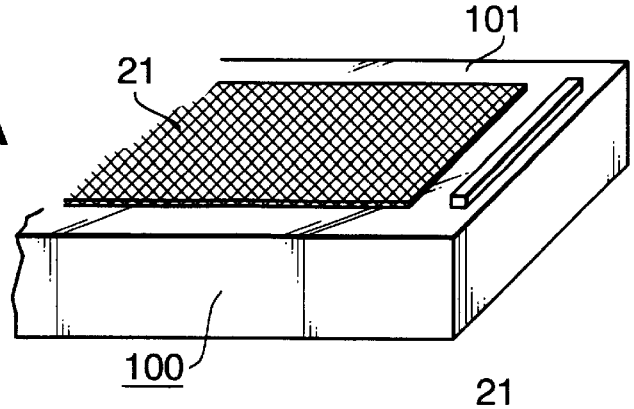
FIGS. 7A through 7D illustrate one example way to fabricate film member of integrated double-layered.
Figure 7B:
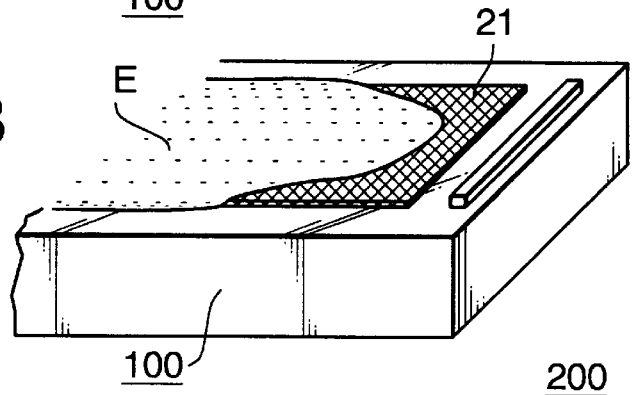
Figure 7C:
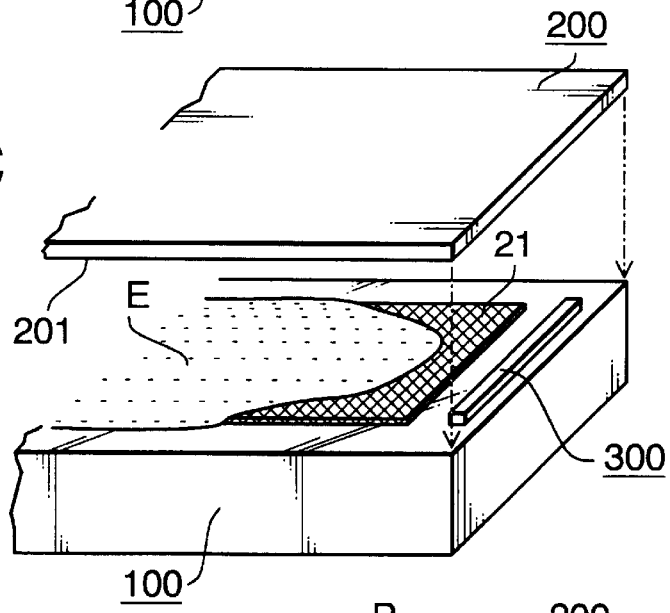
Figure 7D:
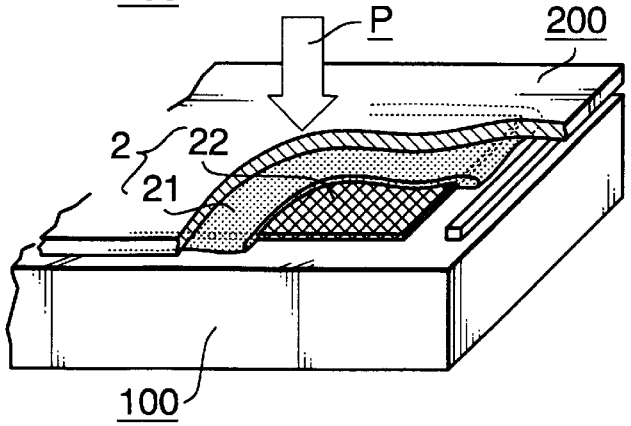

First, a low-frictional material sheet constituting a first layer 21 is securely seated on a supporting base 100 having a mirror surface 101 (FIG. 7A), then an elastomer E in a semi-liquid state is distributed on the low-frictional material to fully cover it (FIG. 7B). An upper cover plate 200 having a mirror surface 201 is put on the supporting base 100 with placing a pair of spacers 300 (only one is shown in FIG. 7C) therebetween, and is kept being pressed downwardly by a pressure P until the elastomer is hardened (FIG. 7D). The height of the spacer 300 corresponds to the total thickness of the first and second layers of the film member. Thereafter, the supporting base 100 and the upper cover plate 200 are released, and the outwardly protruded portions of the hardened elastomer E is cut off.

It is preferable that the surface of the material sheet for a first layer 21 is coated by a silane coupling agent for increasing adhesiveness with the elastomer.

Then, a plurality of slits are formed to extend through the first and second layers of the film member 2. In one embodiment, the thickness of each of the first layer 21 and the second layer 22 is 20 micron meters, i.e., the total thickness of the film member 2 is 40 micron meters, and a plurality of slits each having a length of 10 to 20 micron meters are formed every 400 to 900 square micron meters.

In the meantime, as the pores are formed by making slits by means of an edged tool or the like, some cracks may appear around the inner circumferential surfaces of the pores 25 in the second layer 22 made of the elastomer, after repeated usage thereof. In case cracks are extended inside the second layer 22, the durability thereof will decrease and it becomes difficult to function as designed.

Figure 6:
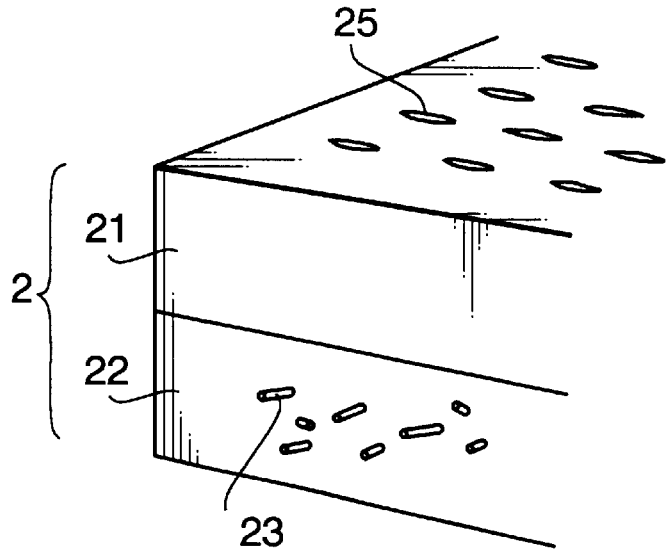
FIG. 6 shows the structure of the modified embodiment of a film member.

Accordingly, it is preferable, in order to avoid the progress of the cracks inside the second layer 22, to disperse a plurality of fillers 23 in the second layer 22, as illustrated in FIG. 6.

As the filler 23, a glass filler which has high adhesiveness with the elastomer is to be selected. In the above embodiment, the filler 23 is of a substantially cylindrical shape having, for instance, a length of less than 10 micron meters and an outer diameter of less than 10 micron meters. The amount of the fillers 23 to be added and dispersed in the elastomer is to be selected not to exceed the amount with which the elastic deformability of the elastomer is not hurt. That is, not less than 0.1 wt % and not more than 20 wt %, and preferably in the range of 1 to 5 wt %.

The fillers 23 should be added and mixed with the elastomer in a semi-liquid state before distributed on the material sheet for a first layer 21. In the above embodiment, 2 wt % of glass fillers each having the diameter of 8 micron meters is added to 100 wt % of the elastomer in a semi-liquid state with 10 wt % of hardening agent (for instance, "cat1300" produced by Shinetsu Silicon K.K.) and mixed up.

The fillers made of the materials other than glass can be employed. In this case, coupling agent might become necessary to be coated on the surface of the filler 23 to increase adhesiveness thereof with the elastomer.

In the meantime, although in the aforementioned embodiments, double-layered film member is employed, more-than-two layered film member may of course be employed. In this case, the uppermost layer thereof corresponds to the above first layer 21, while the lowermost layer thereof should correspond to the second layer 22.

Hereafter, the results of the printing test employed the film members fabricated in accordance with the above-mentioned embodiments will be described in comparison to the prior art film member.

EXAMPLE 1

In this example, polytetrafluoroethylene (Product Name: Nifutoron produced by Nitto Denko K.K.) of the 20 microns thickness is employed. As the elastomer for the second layer 22, dimethylepolysiloxane (Product Name: KE1300 produced by Shinetsu Silicon K.K.) of the 20 microns thickness is employed. The film member 2 thus fabricated is applied to the printer of FIG. 1 and the printing test is performed. As a result, printing was clearly and continuously done on 20 recording sheets of A4 size.

EXAMPLE 2

In this example, glass fillers each having the diameter of 8 micron meters, and the length of 10 micron meters are dispersed in the second layer 22 of the Example 1. The film member 2 thus fabricated is applied to the printer of FIG. 1 and the printing test is performed. As a result, printing was clearly and continuously done on 40 recording sheets of A4 size.

COMPARATIVE EXAMPLE

A single-layered film of the thickness of 20 micron meters made of polytetrafluoroethylene is employed as the film member in the printer of FIG. 1, and the printing test has been performed. As a result, trailings of ink were shown on the recording sheet, and clear printing was not performed.

The present disclosure relates to subject matters contained in Japanese Patent Application No. Hei 11-089449 filed on Mar. 30, 1999, which is expressly incorporated herein by reference in its entirety.

What is claimed is:

1. A film member adapted to be employed in an ink-transfer-type printer in which a film member having a plurality of pores is disposed between a recording sheet and ink, said ink and film member being heated by a heating means so that said pores are selectively expanded to allow said ink to permeate said expanded pores to be transferred onto a recording sheet, said film member comprises:

at least an integrated pair of layers, the uppermost layer of which is made of a low-friction material whose elasticity is changed when heated, while the lowermost layer is made of an elastomer, said plurality of pores being formed to extend through the integrated layers.

2. The film member according to claim 1, wherein said uppermost layer faces a recording sheet to contact therewith when employed in said ink-transfer-type printer, while said lowermost layer faces said thermal line head through ink.

3. The film member according to claim 1, wherein said low-friction material is one of or the mixture of more than one of polytetrafluoroethylene, polydifluoroethylene, polyurethane and polyethylene.

4. The film member according to claim 1, wherein said elastomer is one of or the mixture of more than one of silicon rubber, polyethylene, polypropylene, polyvinyl acetate, chloroprene, isoprene, polyurethane and polyamide.

5. The film member according to claim 1, wherein a plurality of fillers are dispersed in said lowermost layer.

6. The film member according to claim 5, wherein each of said fillers is of a substantially cylindrical shape made of glass, and the amount of the fillers to be dispersed is in the range of 0.1 wt % to 20 wt % of said lowermost layer.

7. The film member according to claim 6, wherein the amount of said fillers is in the range of 1 wt % to 5 wt %.

8. The film member according to claim 1, wherein said lowermost layer is directly integrated with said uppermost layer.

* * * * *